US008011999B2

(12) United States Patent
Nagase et al.

(10) Patent No.: US 8,011,999 B2
(45) Date of Patent: Sep. 6, 2011

(54) POLISHING PAD, METHOD FOR MANUFACTURING THE POLISHING PAD

(75) Inventors: Hiromasa Nagase, Kawasaki (JP); Akio Yokofuke, Kawasaki (JP); Hiroshi Misawa, Kawasaki (JP)

(73) Assignee: Fujitsu Semiconductor Limited, Yokohama (JP)

( * ) Notice: Subject to any disclaimer, the term of this patent is extended or adjusted under 35 U.S.C. 154(b) by 724 days.

(21) Appl. No.: 11/774,779

(22) Filed: Jul. 9, 2007

(65) Prior Publication Data

US 2008/0009228 A1 Jan. 10, 2008

(30) Foreign Application Priority Data

Jul. 10, 2006 (JP) ..... 2006-189424

(51) Int. Cl.
*B24D 11/00* (2006.01)

(52) U.S. Cl. ..... 451/527; 51/293; 51/298; 356/237.1

(58) Field of Classification Search ..... 51/298, 51/293; 356/237.1, 237.2; 451/527
See application file for complete search history.

(56) References Cited

U.S. PATENT DOCUMENTS

| | | | | |
|---|---|---|---|---|
| 5,650,619 | A * | 7/1997 | Hudson | 250/302 |
| 5,825,028 | A * | 10/1998 | Hudson | 250/302 |
| 6,568,996 | B2 * | 5/2003 | Kobayashi et al. | 451/36 |
| 6,650,408 | B2 | 11/2003 | Jun et al. | |
| 6,821,195 | B1 * | 11/2004 | Pham et al. | 451/388 |
| 7,027,640 | B2 * | 4/2006 | Park et al. | 382/152 |
| 7,037,179 | B2 * | 5/2006 | Blalock | 451/57 |
| 2004/0014413 | A1 | 1/2004 | Kawahashi et al. | |
| 2007/0034614 | A1 * | 2/2007 | McClain et al. | 219/121.69 |
| 2007/0254564 | A1 * | 11/2007 | Song et al. | 451/64 |

FOREIGN PATENT DOCUMENTS

| | | | |
|---|---|---|---|
| JP | 8-229805 | A | 9/1996 |
| JP | 2002-92593 | A | 3/2002 |
| JP | 2002-160153 | A | 6/2002 |
| JP | 2002-194104 | A | 7/2002 |
| JP | 2003-103470 | A | 4/2003 |
| JP | 2004-140178 | A | 5/2004 |
| JP | 2005-19886 | A | 1/2005 |
| JP | 2005-91264 | A | 4/2005 |
| JP | 2006-77044 | A | 3/2006 |

* cited by examiner

*Primary Examiner* — Timothy V Eley

(74) *Attorney, Agent, or Firm* — Westerman, Hattori, Daniels & Adrian, LLP

(57) ABSTRACT

A polishing pad with first plural concave portions regularly allocated with prescribed spacing or/and a groove formed on the surface of the polishing pad; and a second concave portion randomly allocated without corresponding to the first plural concave portions or/and the groove formed on the surface of the polishing pad.

6 Claims, 4 Drawing Sheets

POLISHING PAD, METHOD FOR MANUFACTURING THE POLISHING PAD

CROSS-REFERENCE TO RELATED APPLICATIONS

This application is based upon and claims the benefit of priority from the prior Japanese Patent Application No. 2006-189424, filed on Jul. 10, 2006, the entire contents of which are incorporated herein by reference.

TECHNICAL FILED

The present invention relates to a polishing pad, a method for manufacturing the polishing pad, and a method for polishing an object.

BACKGROUND OF THE INVENTION

In manufacturing steps of a semiconductor device such as a semiconductor integrated circuit element, an active element such as a MIS transistor, a passive element such as a capacitative element, and a wiring layer, where these functional elements are mutually connected are formed on the principal surface of a semiconductor substrate (for example, semiconductor wafer).

When the functional elements, the wiring layer and an insulating layer to provide isolatation among the other elements are formed on the substrate, a chemical mechanical polish (CMP) method is applied for thinning and planarizing.

During the CMP processing, abrasive agent (slurry) is supplied onto the surface of a polishing pad (abrasive cloth) located on a disk-shaped polishing table (surface table, platen), the polishing table is rotated, a rotating object to be polished, that is the polished surface of the semiconductor substrate, is contacted to the polishing pad, and the surface is polished.

In such a CMP processing, the polishing pad located on the polishing table needs to have a structure that has high retentiveness of abrasive agent supplied onto the surface (polished surface), the abrasive agent must be efficiently moved all over the surface of the polishing pad, and further product material generated at polishing must be efficiently discharged.

As a result, the polishing pad is equipped with a foam structure on its surface (polished surface) or is equipped with high retentiveness of the abrasive agent by roughening the surface with dressing processing.

The foam part forms micropores, and keeps abrasive particles in the abrasive agent.

As a polishing pad that has the foam structure, there is, for example, foamed polyurethane having an independent foam structure. It is formed by mixing and stirring an isocyanate group containing chemical compound, active hydrogen containing chemical compound and foaming agent, injecting the mixture into a mold, heating and hardening it to obtain a molded body, and cutting it into a prescribed thickness. (For example, refer to Japanese Patent Application laid-open No. 2002-194104 and No. 2006-77044.)

On the other hand, it has also been proposed to allocate plural concave portions (holes) on the sheet-like formed surface of the polishing pad, that is the polished surface, to retain the abrasive agent. (For example, refer to the United States published application No. 2004-014413 and Japanese Patent Application laid-open No. Hei-8-229805.)

In addition, a structure in which a groove is allocated on the polishing surface of the polishing pad to improve the mobility of the abrasive agent and efficiently discharge the product material generated at polishing has been proposed. (For example, refer to Japanese Patent Application laid-open No. 2003-103470 and No. Hei-8-229805.)

In addition, it has also been proposed to allocate both the concave portions (holes) and the groove on the polishing surface of the polishing pad. (For example, refer to Japanese Patent Application laid-open No. 2002-160153 and No. 2004-140178.)

The surface of the polishing pad (the polishing surface) may not always be formed homogeneously due to factors such as material composition, stirring condition or processing temperature condition. (For example, refer to Japanese Patent Application laid-open No. 2002-92593 and No. 2005-19886.)

In addition, contamination may occur during processing such as stirring, mixing or molding. As such, the polishing pad may have malformed portions.

It is difficult to utilize a polishing pad including a defective part resulting from malformation of the polishing pad in the CMP process.

On the other hand, prior to performing the CMP processing, it is proposed to optically examine the surface state of the polishing pad by placing the polishing pad on the polishing table, and having a worker remove the defect part depending on the examination result. (For example, refer to the U.S. Pat. No. 6,650,408.)

However, the most cases in which the worker can remove the defective part prior to the CMP processing are limited to when the defect is due to contamination attached onto the surface of the polishing pad.

If defective parts of the pad are caused by the manufacturing of the pad and the defective part is within the pad, where it is difficult to remove, such as inside the polishing pad or inside the surface part, the polishing pad may be used rather than disposed.

As a result, the conventional polishing pad will not be used effectively, resulting in inefficiency and increased cost to the manufacturing process of the semiconductor device.

SUMMARY

A polishing pad in accordance with various embodiments of the present invention, comprises first plural concave portions regularly allocated with prescribed spacing or/and a groove formed on the surface of the polishing pad; and a second concave portion allocated without corresponding to the first plural concave portions or/and the groove formed on the surface of the polishing pad.

DETAILED DESCRIPTION OF THE EMBODIMENTS

FIG. 1 is a figure that shows the structure of the polishing pad in accordance with an embodiment of the present invention.

Figure 1A:
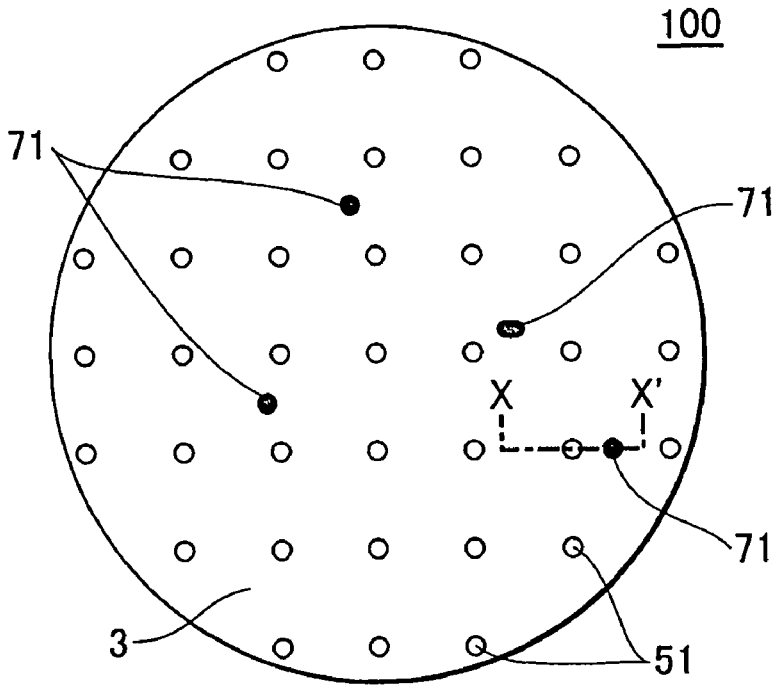
FIGS. 1(A) and (B) are a plan view and cross-sectional view that shows the structure of the polishing pad in accordance with an embodiment of the present invention.
Figure 1B:
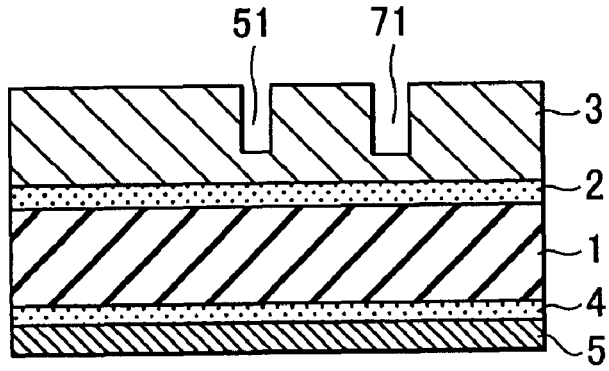

FIG. 1(B) shows a cross section X-X' of FIG. 1(A).

In FIGS. 1(A) and (B), a polishing pad 100 has a base material 1 that includes polyurethane or non-woven fabric, and a polishing pad layer 3 that includes a foamed polyurethane sheet allocated on the one principal surface of the basic material 1 via adhesive 2.

An exfoliate paper 5 is located on the other principal surface of the basic material 1 via adhesive 4. The exfoliate paper 5 is peeled off and removed when the polishing pad 100 is applied to the polishing table.

As further shown in FIG. 1, the polishing pad layer 3 including the foamed polyurethane sheet includes plural concave portions 51 regularly allocated with prescribed spacing on the surface that touches the object to be polished, and random concave portions 71 allocated without corresponding to the regular allocation of the plural concave portions 51.

The concave portions 51 are allocated with the aim of efficiency and homogenization of the polishing rate by accommodating and retaining the abrasive agent (slurry) on the surface of the polishing pad.

On the other hand, the concave portion 71 is formed as a result of selectively removing the defective parts including an inhomogeneous part when foamed polyurethane was malformed or a contaminated part.

As a result, the position, size, shape, and number of the concave portion 71 are not constant. As for the depth of the concave portions 71, they need to not be deep enough to penetrate the polishing pad but deep enough to enable removal of the defective part.

Figure 2A:
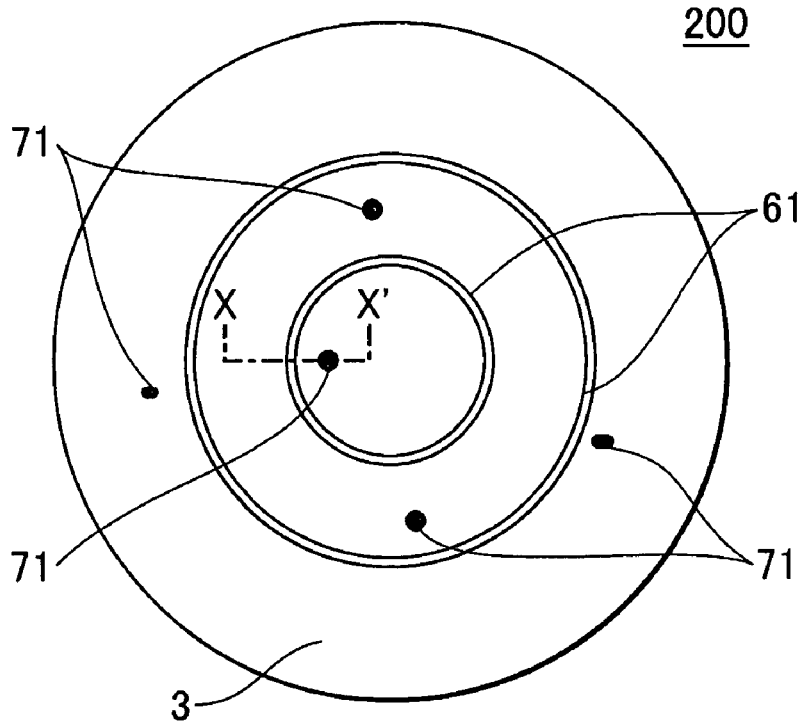
FIGS. 2(A) and (B) are a plan view and cross-sectional view that shows the structure of the polishing pad in accordance with another embodiment of the present invention.

FIGS. 2(A) and (B) shows the structure of the polishing pad in accordance with another embodiment of the present invention.

Figure 2B:
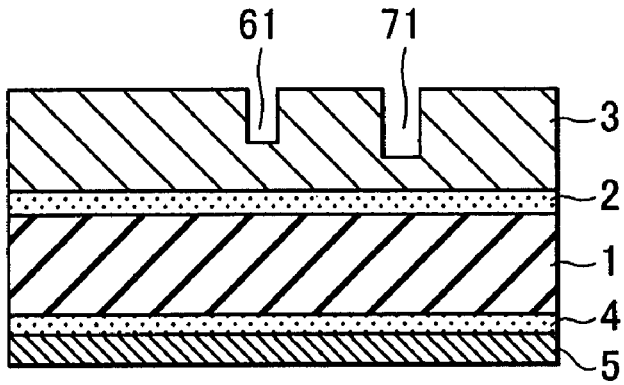

FIG. 2(B) shows a cross section X-X' of FIG. 2(A).

In FIGS. 2(A) and (B), a polishing pad 200 has a basic material 1 that includes non-woven fabric or polyurethane, and the polishing pad layer 3 that includes a foamed polyurethane sheet located on the principal surface of the basic material 1 via adhesive 2.

An exfoliate paper 5 is located on the other principal surface of the basic material 1 via adhesive 4. The exfoliate paper 5 is peeled off and removed when the polishing pad 100 is applied to the polishing table.

As further shown in FIG. 2, the polishing pad layer 3 including the foamed polyurethane sheet, includes a concentric groove 61 located on the surface that touches the object to be polished and random concave portions 71 allocated without corresponding to the location of the groove 61.

The groove 61 is formed with the aim of homogenization of the polishing rate by easing the flow of the abrasive agent (slurry) on the surface of the polishing pad.

On the other hand, the concave portions 71 were formed as a result of selectively removing the defect parts including inhomogeneous parts generated when foamed polyurethane was malformed or a contaminated part.

As a result, the position, size, shape, and number of the concave portions 71 are not constant. As for the depth of the concave portions 71, they must not be deep enough to penetrate the polishing pad but deep enough to enable removal of the defect part.

Even when the intentionally formed concave portions 51 and the groove 61 are combined on the polishing part respectively so as to be located on a single polishing pad (not shown), random concave portions 71 related to the removal of the defective parts are allocated without corresponding to the intentionally formed concave portions 51 and the groove 61.

In addition, the quantity, allocating position, shape, and combination of the concave portions 51 and the groove 61 on the polishing pad 100 and the polishing pad 200 respectively are arbitrarily selected according to need.

Further, though the above embodiment explains an independent foam type-polishing pad using foamed polyurethane as one example, the present invention is not limited to an independent foam structure, but can also be applied to a polishing pad comprising a continuous foam structure or foam free structure.

Figure 3:
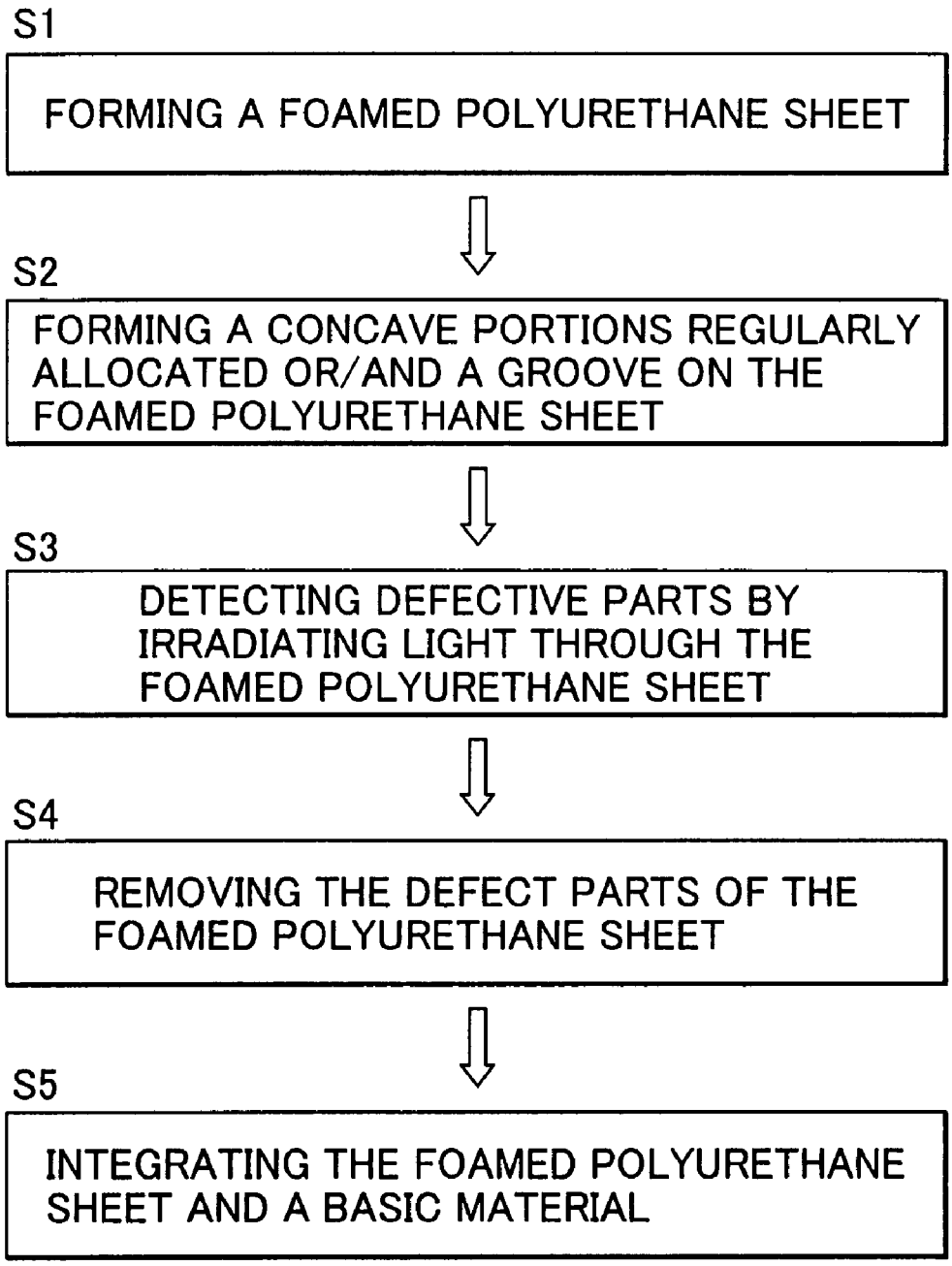
FIG. 3 is a figure that shows a method of manufacturing the polishing pad 100 of FIG. 1 or the polishing pad 200 of FIG. 2.

FIG. 3 shows a method of manufacturing the polishing pad 100 of FIG. 1 or the polishing pad 200 of FIG. 2.

Sheet-like foamed polyurethane is formed by mixing and stirring an isocyanate group containing chemical compound, an active hydrogen containing chemical compound and foaming agent, injecting the mixture into a mold, heating and hardening it to obtain a molded body, and cutting it into a prescribed thickness (Step S1).

Next, concave portions (the concave portions 51) or a groove (the groove 61) are regularly allocated on the foamed polyurethane sheet with prescribed spacing (Step S2).

The concave portions 51 or the groove 61 can be formed by press punching, cutting work, laser processing, or selective melt processing.

Next, radiation that penetrates through the foamed polyurethane sheet is irradiated to the foamed polyurethane sheet to detect defective parts on the foamed polyurethane sheet (Step S3). As radiation, it can be selected from among visible light, ultraviolet, infrared rays, laser beam, electron beam or X rays arbitrarily. For example, the defective parts are detected by scanning the inspected foamed polyurethane sheet with a visible light source lamp along a surface of the foamed polyurethane sheet and detecting the state (strength) of the penetrated light on the other surface of the polyurethane sheet.

That is, the amount of light penetration changes in a heterogeneous part in the foamed polyurethane sheet.

In addition, strength of light penetration decreases locally in a contaminated part in the foamed polyurethane sheet if there is contamination in it.

Like this, the part where the amount of radiation penetration changes can be regarded as a defective part including a heterogeneous part, or a defective part including a contaminated part.

Next, removal processing is performed on the defective parts detected by the above means.

That is, press punching, cutting work, laser processing, or selective melt processing is applied to the defective parts to selectively remove them. (Step S4)

As a result, random concave portions (concave portion 71) are formed in the removed parts.

Removal processing of the defective parts can be automated based on the data detected by penetrated radiation.

The random concave portions (the concave portions 71) formed by selective removal processing of the defective parts does not correspond to the intentionally formed concave portions (the concave portions 51) regularly allocated with prescribed spacing nor do the random concave portions 71 correspond to the groove (the groove 61).

The shape, area, and depth of the concave portions 71 are selected depending on the position of the corresponding defective parts.

That is, the shape may not be limited to a circle, but may be an oval or polygon, and the area is also regarded as an amount of necessary area to remove the defective part.

In addition, the depth must not be deep enough to penetrate through the foamed polyurethane sheet but needs to be deep enough so that the defect part can be completely removed.

As a result, depending on the position where a defective part exists, there may be a case in which the random concave portion 71 and the intentionally formed concave portions (the concave portions 51) or the groove (groove 61) are overlapped.

The foamed polyurethane sheet in which the prescribed concave portions (concave portions 51) or the prescribed groove (groove 61), and the random concave portions (the concave portions 71) are formed, and from which the defect part due to a heterogeneous part in the structural material or the defect part due to contamination is removed, is attached to a basic material (a basic material 1) including a urethane sheet or a non-woven fabric via adhesive (adhesive 2) and they are integrated (Step 5).

As a result, the foamed polyurethane sheet on the surface of the formed polishing pad is free from any defective parts that result from a heterogeneous part or a contaminated part during the polishing pad formation.

As a result, if this polishing pad is applied during a CMP process, uniform polishing processing can be performed without damaging (scratching) the object to be polished.

In the above-mentioned process, it is possible to swap the step (Step S2) of regularly allocating the concave portions (the concave portions 51) or allocating the groove (the groove 61), for the step (Step S4) to remove the defective parts.

That is, after the detecting processing (Step 3) of the defective parts, it is also possible to take steps in which, first, the defective part is removed and the random concave portion (the concave portion 71) is formed, then after a prescribed interval, the intentionally formed concave portions (the concave portions 51) or the groove (the groove 61) is allocated.

Further, it is also possible not to attach the foamed polyurethane sheet from which the defective part was removed, to the basic material (basic material 1) to integrate both, but to directly allocate an adhesive layer to the reverse side of the foamed polyurethane sheet and adopt it alone to the CMP processing.

Figure 4:
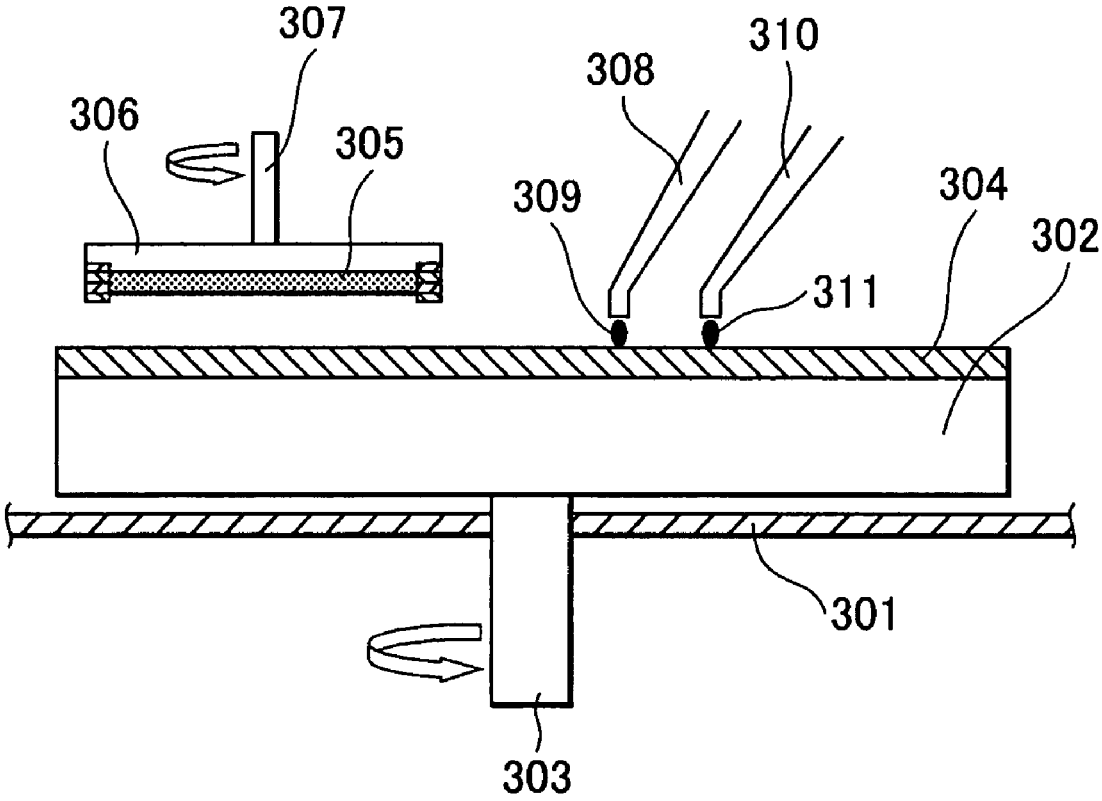
FIG. 4 is a figure that shows a polishing apparatus utilizing the polishing pad 100 of FIG. 1 or the polishing pad 200 of FIG. 2.

FIG. 4 shows a polishing apparatus utilizing the polishing pad 100 of FIG. 1 or the polishing pad 200 of FIG. 2.

As shown in FIG. 4, a disk-shaped polishing table 302 (surface table, platen) is rotatably supported on a base 301 of the polishing device via a rotation axis 303.

A polishing pad 304 that has the concave portions (concave portions 51) regularly allocated with prescribed spacing and/or the groove (groove 61), and the random concave portion (concave portion 71) formed as a result of removing the defective parts (due to a heterogeneous part or a contaminated part caused when the polishing pad 304 was manufactured) is prepared.

The polishing pad 304 is attached and fixed on the polishing table 302 with a double-faced adhesive tape.

As further shown in FIG. 4, a semiconductor substrate 305 that is a polished object is located on a polishing head 306, and rotatably supported via a rotation axis 307 that supports the polishing head 306.

In addition, abrasive agent (slurry) 309 is supplied onto the polishing pad 304 through a nozzle 308.

Further, pure water 311 is supplied onto the polishing pad 304 through a nozzle 310.

The nozzle 308 supplies the abrasive agent 309 onto the polishing pad 304, and the nozzle 310 supplies the pure water 311 in the CMP device comprising such a structure.

While the polishing table 302 is rotating, the polished part of the polished semiconductor substrate 305 that is located on the polishing head 306 is rotated and pressed against the polishing pad 304 that is located on the polishing table 302.

A polished part could be an insulating layer, a metal layer, or a semiconductor layer allocated on the principal surface of the semiconductor substrate 305 depending on the step.

In addition, the semiconductor substrate itself might become the polished part, that is, the object of the CMP processing.

Such a CMP process does not generate the heterogeneity of the polishing rate or the damage (scratch) due to the existence of defective parts in the polished part of the polished object because the defective parts on the polishing pad 304 are removed beforehand.

Hence, even a polishing pad where defective parts were generated during the manufacturing process can be used, resulting in improved efficiency and a lower cost of manufacturing for the semiconductor device.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A method for manufacturing a polishing pad, the method comprising:

forming a foamed polyurethane sheet;

forming first concave portions or/and grooves regularly allocated on the foamed polyurethane sheet;

after forming the first concave portions or/and the grooves, detecting defective parts of the foamed polyurethane sheet by irradiating light through the foamed polyurethane sheet; and after detecting the defective parts, removing the detected defective parts and thereby forming second concave portions on the foamed polyurethane sheet.

2. The method for manufacturing the polishing pad according to claim 1, wherein the forming the concave portions comprises at least one of the group consisting of: cutting work and selective melt processing.

3. The method for manufacturing the polishing pad according to claim 1 further comprising:

forming third plural concave portions regularly arranged on the polishing pad.

4. The method for manufacturing the polishing pad according to claim 1, wherein the radiation is at least one selected from the group consisting of: ultraviolet, infrared rays, laser beam, electron beam and X rays.

5. The method for manufacturing the polishing pad according to claim 1, wherein at least one of the defective parts is a heterogeneous part.

6. The method for manufacturing the polishing pad according to claim 1, wherein at least one of the defective parts is a contaminated part.

* * * * *